US009511258B2

(12) United States Patent
Hoole

(10) Patent No.: US 9,511,258 B2
(45) Date of Patent: Dec. 6, 2016

(54) WEIGHTED PUSH-UP EXERCISE MACHINE

(71) Applicant: Richard J. Hoole, New Smyrna Beach, FL (US)

(72) Inventor: Richard J. Hoole, New Smyrna Beach, FL (US)

( * ) Notice: Subject to any disclaimer, the term of this patent is extended or adjusted under 35 U.S.C. 154(b) by 71 days.

(21) Appl. No.: 14/075,277

(22) Filed: Nov. 8, 2013

(65) Prior Publication Data

US 2014/0274620 A1 Sep. 18, 2014

Related U.S. Application Data

(63) Continuation-in-part of application No. 13/950,179, filed on Jul. 24, 2013, which is a continuation-in-part of application No. 13/840,168, filed on Mar. 15, 2013, now Pat. No. 9,028,380, which is a continuation-in-part of application No. 12/944,808, filed on Nov. 12, 2010, now Pat. No. 8,734,305, which is a continuation-in-part of application No. 12/658,855, filed on Feb. 16, 2010, now Pat. No. 8,147,389, which is a continuation-in-part of application No. 12/156,487, filed on Jun. 2, 2008, now Pat. No. 7,918,770, which is a continuation-in-part of application No. 11/811,920, filed on Jun. 11, 2007, now Pat. No. 7,871,360.

(51) Int. Cl.

| | |
|---|---|
| ***A63B 21/08*** | (2006.01) |
| ***A63B 23/12*** | (2006.01) |
| ***A63B 21/04*** | (2006.01) |
| ***A63B 21/055*** | (2006.01) |
| ***A63B 21/06*** | (2006.01) |
| ***A63B 21/068*** | (2006.01) |

(52) U.S. Cl.

CPC ..... *A63B 23/1236* (2013.01); *A63B 21/0421* (2013.01); *A63B 21/0552* (2013.01); *A63B 21/068* (2013.01); *A63B 21/0615* (2013.01); *A63B 21/4007* (2015.10)

(58) Field of Classification Search

CPC ..... A63B 21/00; A63B 21/00087; A63B 21/0009; A63B 21/00094; A63B 21/0012; A63B 21/00123; A63B 21/00127; A63B 21/00138; A63B 21/00149; A63B 21/00152; A63B 21/0085; A63B 21/0087; A63B 21/0088; A63B 21/02; A63B 21/04; A63B 21/0407; A63B 21/0414; A63B 21/0615; A63B 21/065; A63B 21/1457; A63B 21/1461; A63B 21/1465; A63B 21/1496; A63B 23/03516; A63B 23/03541; A63B 23/12; A63B 23/1209; A63B 23/1227; A63B 23/1236; A63B 2208/0257; A63B 2208/0295

See application file for complete search history.

(56) References Cited

U.S. PATENT DOCUMENTS 3,822,599 A * 7/1974 Brentham ..... 482/113
3,918,710 A * 11/1975 Niebojewski ..... 482/97

(Continued)

*Primary Examiner* — Oren Ginsberg
*Assistant Examiner* — Gary D Urbiel Goldner
(74) *Attorney, Agent, or Firm* — Matthew G. McKinney, Esq.; Allen, Dyer, Doppelt, Milbrath & Gilchrist, P.A.

(57) ABSTRACT

A weighted push-up exercise machine includes a lever arm having a proximate end coupled pivotally to a base. The lever arm is configured to provide a resistance against vertical movement of a distal end of the lever arm. In addition, the distal end of the lever arm is configured to receive a connector suspended from a belt or harness worn by a user. A pair of hand grips are disposed above the lever arm and the pair of hand grips are configured to be grasped by the user. The machine is configured for the user to use in a horizontal position by the user grasping the hand grips and performing push-up exercises against the resistance. The machine also includes an elevated platform that is adjustably positioned in height relative to the pair of hand grips.

16 Claims, 6 Drawing Sheets

(56) References Cited

U.S. PATENT DOCUMENTS

| | | | | | |
|---|---|---|---|---|---|
| 4,332,381 | A * | 6/1982 | Lyons | 482/140 | |
| 4,357,010 | A * | 11/1982 | Telle | 482/97 | |
| 4,406,452 | A * | 9/1983 | Lapcevic | 482/97 | |
| 4,465,274 | A * | 8/1984 | Davenport | 482/113 | |
| 4,492,375 | A * | 1/1985 | Connelly | 482/138 | |
| 4,674,160 | A * | 6/1987 | Gibson | A63B 21/06 | 482/139 |
| 4,846,458 | A * | 7/1989 | Potts | A63B 21/00181 | 482/113 |
| 4,951,939 | A * | 8/1990 | Peters | 482/94 | |
| 5,000,440 | A * | 3/1991 | Lynch | 482/54 | |
| 5,058,884 | A * | 10/1991 | Fuller, Sr. | 482/97 | |
| 5,104,119 | A * | 4/1992 | Lynch | 482/5 | |
| 5,106,079 | A * | 4/1992 | Escobedo et al. | 482/97 | |
| 5,116,297 | A * | 5/1992 | Stonecipher | 482/97 | |
| 5,171,196 | A * | 12/1992 | Lynch | 482/7 | |
| RE34,212 | E * | 4/1993 | Potts | A63B 21/00181 | 482/113 |
| 5,312,313 | A * | 5/1994 | Holmes | A63B 21/00181 | 482/51 |
| 5,330,408 | A * | 7/1994 | Westmoreland, Jr. | 482/141 | |
| 5,582,565 | A * | 12/1996 | Soria | 482/141 | |
| 5,637,063 | A * | 6/1997 | Fuller, Sr. | 482/97 | |
| 5,813,951 | A * | 9/1998 | Einsig | 482/97 | |
| 5,830,115 | A * | 11/1998 | Chen | 482/96 | |
| 5,941,804 | A * | 8/1999 | Johnston et al. | 482/97 | |
| 6,217,483 | B1 * | 4/2001 | Kallassy | 482/38 | |
| 6,387,023 | B1 * | 5/2002 | Liga, Jr. | 482/130 | |
| 6,482,139 | B1 * | 11/2002 | Haag | 482/121 | |
| 6,802,800 | B1 * | 10/2004 | Hobson | 482/97 | |
| 7,029,426 | B1 * | 4/2006 | Fuller, Sr. | 482/97 | |
| 7,104,936 | B2 * | 9/2006 | Karlstrom | 482/137 | |
| 7,104,938 | B1 * | 9/2006 | Smith | 482/142 | |
| 7,488,277 | B1 * | 2/2009 | Knapp | 482/104 | |
| 7,530,936 | B1 * | 5/2009 | Hall | 482/142 | |
| 7,588,521 | B1 * | 9/2009 | Fazzari | 482/141 | |
| 7,608,020 | B2 * | 10/2009 | Mason | 482/97 | |
| 7,976,439 | B2 * | 7/2011 | Abelbeck | 482/93 | |
| 8,172,731 | B1 * | 5/2012 | Bredda | 482/94 | |
| 2003/0134722 | A1 * | 7/2003 | Greenland | 482/100 | |
| 2003/0134723 | A1 * | 7/2003 | Greenland | 482/104 | |
| 2003/0232703 | A1 * | 12/2003 | Webber | 482/95 | |
| 2004/0009855 | A1 * | 1/2004 | Webber | 482/94 | |
| 2004/0023761 | A1 * | 2/2004 | Emery | 482/94 | |
| 2004/0097352 | A1 * | 5/2004 | Bergman et al. | 482/141 | |
| 2005/0003938 | A1 * | 1/2005 | Henderson | 482/143 | |
| 2005/0148445 | A1 * | 7/2005 | Carle | 482/97 | |
| 2006/0063650 | A1 * | 3/2006 | Francis | 482/94 | |
| 2007/0054788 | A1 * | 3/2007 | Johnston et al. | 482/97 | |
| 2007/0161469 | A1 * | 7/2007 | Lamle et al. | 482/94 | |
| 2010/0009818 | A1 * | 1/2010 | Simonson et al. | 482/97 | |
| 2010/0022362 | A1 * | 1/2010 | MacDonald | 482/94 | |
| 2014/0011645 | A1 * | 1/2014 | Johnson et al. | 482/121 | |
| 2014/0057767 | A1 * | 2/2014 | Henniger et al. | 482/142 | |
| 2014/0213414 | A1 * | 7/2014 | Balandis et al. | 482/5 | |

* cited by examiner

FIG. 10
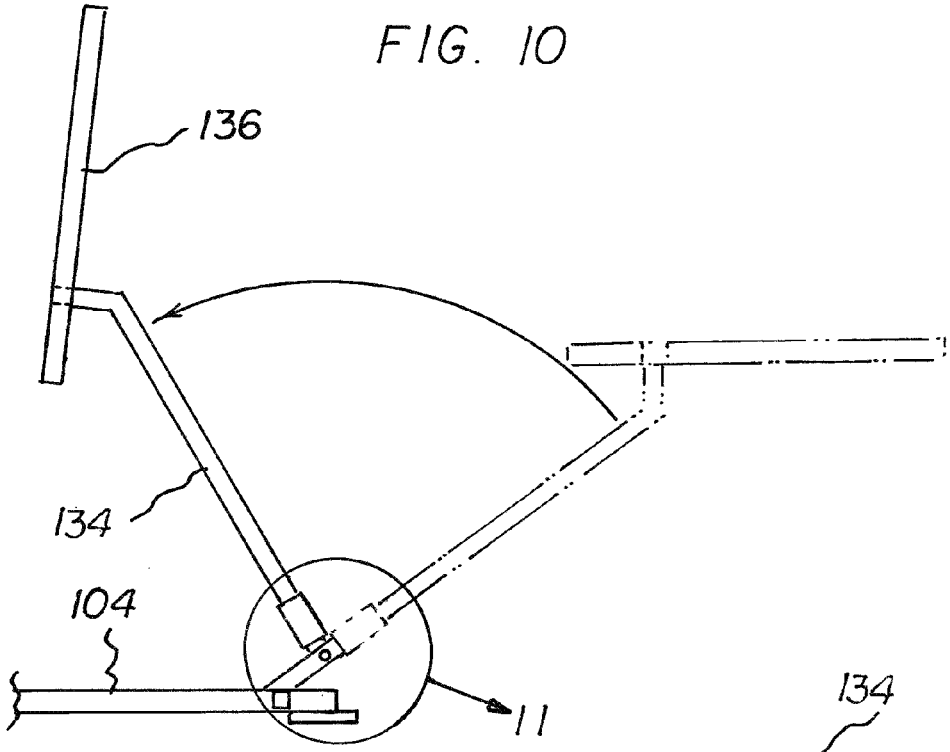
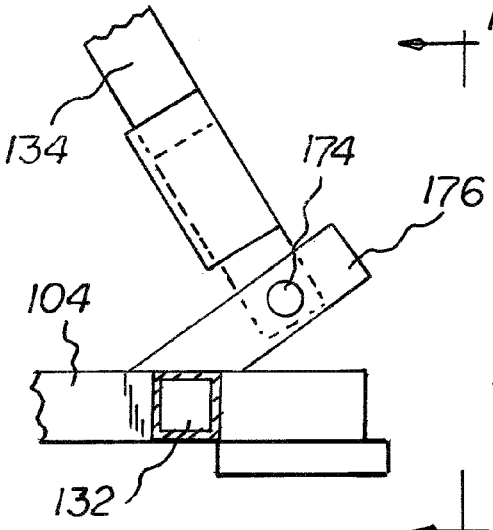
FIG. 11
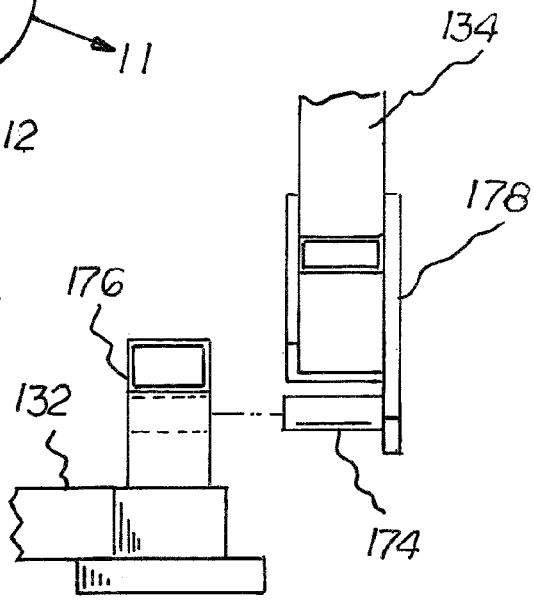
FIG 12

WEIGHTED PUSH-UP EXERCISE MACHINE

I. CROSS REFERENCE TO RELATED APPLICATIONS

This application is a continuation-in-part of pending U.S. patent application Ser. No. 13/950,179 filed Jul. 24, 2013, which is a continuation-in-part of U.S. patent application Ser. No. 13/840,168 filed Mar. 15, 2013, which is a continuation-in-part of U.S. patent application Ser. No. 12/944,808 filed Nov. 12, 2010, now U.S. Pat. No. 8,734,305, which is a continuation-in-part of U.S. patent application Ser. No. 12/658,855 filed Feb. 16, 2010, now U.S. Pat. No. 8,147,389, which is a continuation-in-part of U.S. patent application Ser. No. 12/156,487 filed Jun. 2, 2008, now U.S. Pat. No. 7,918,770, which is a continuation-in-part of U.S. patent application Ser. No. 11/811,920 filed Jun. 11, 2007, now U.S. Pat. No. 7,871,360 which are incorporated herein by reference in their entireties.

II. FIELD

The present disclosure is generally related to a weighted push-up exercise machine.

III. DESCRIPTION OF RELATED ART

The objectives of exercise can be to increase strength, tone, mass, or muscular endurance. To achieve these objectives, many people lift free weights such as dumbbells or use a weight machine. For example, chest muscle strengthening and development is achieved through weight lifting. Bench press, chest butterfly, and cross-over pulls are common weight lifting exercises that target the chest. Other types of exercise may use resistance bands, tubing or pneumatic resistance.

In addition, body weight can be used to provide resistance such as when performing push-up exercises. Conventional push-up exercises are performed by a person in a horizontal position with the hands under the body at approximately the shoulders with the elbows bent. The arms are used to push against the weight of the body to move the chest up and down.

The push-up exercise is effective in increasing muscle fiber over using free weights or machines. Push-up exercises are predominantly used to develop upper body strength and are considered a body weight exercise because the body weight of the person is what provides the resistance. Body weight exercises require the person to stabilize and balance the weight in order to lift the body. This need for balance requires that numerous muscle groups be incorporated, and therefore push-up exercises and other body weight exercises provide strengthening beyond just those muscles primarily involved in actually displacing the body weight. The muscles predominantly involved in conventional push-up exercises are the arms, the shoulders, the chest, and the core muscle groups of the back and abdominals.

However, a shortcoming of the push-up exercise is that the resistance is limited to the person's own body weight. Accordingly, in the past, people have attempted to increase resistance by having a partner push the person down or sit on the person's back. Others have tried placing free weights or sand bags onto the person's back. Still others have used a resistance band stretched over the person's back. However, all these attempts of a weighted push-up exercise are difficult to implement and increase the risk of injury to the person.

Accordingly, what is needed in the art is a weighted push-up exercise machine that allows a person to safely perform weighted push-up exercises with the natural movement of the person while safely increasing the resistance.

IV. SUMMARY

The following presents a simplified summary of one or more embodiments in order to provide a basic understanding of some aspects of such embodiments. This summary is not an extensive overview of the one or more embodiments, and is intended to neither identify key or critical elements of the embodiments nor delineate the scope of such embodiments. Its sole purpose is to present some concepts of the described embodiments in a simplified form as a prelude to the more detailed description that is presented later.

In a particular embodiment, a weighted push-up exercise machine is disclosed. The machine includes a base structure having a pair of front vertical frame members fixed to the base structure and extending upwardly therefrom, a pair of rear vertical frame members fixed to the base structure and extending upwardly therefrom, and a pair of cross members that connect the front and rear vertical members to each other, respectively. A horizontal member also spans between the pair of rear vertical frame members. In addition, the machine includes a lever arm having a proximate end coupled pivotally to the horizontal member where the lever arm is configured to provide a resistance against vertical movement of a distal end of the lever arm. A flange extends outwardly from the distal end of the lever arm, where the flange is configured to receive a connector suspended from a belt or harness worn by a user. The machine also includes a pair of hand grips disposed above the flange where the pair of hand grips are configured to be grasped by the user. An elevated platform is spaced apart from the pair of hand grips and is configured to support feet of a user, where the machine is adapted for the user to use in a horizontal position by the user grasping the hand grips and resting the feet of the user on the elevated platform and performing push-up exercises while connected to the flange and pushing against the resistance of the lever arm.

To the accomplishment of the foregoing and related ends, one or more embodiments comprise the features hereinafter fully described and particularly pointed out in the claims. The following description and the annexed drawings set forth in detail certain illustrative aspects and are indicative of but a few of the various ways in which the principles of the embodiments may be employed. Other advantages and novel features will become apparent from the following detailed description when considered in conjunction with the drawings and the disclosed embodiments are intended to include all such aspects and their equivalents.

IV. BRIEF DESCRIPTION OF THE DRAWINGS

FIG. 10 is an elevational view of the elevated platform of the weighted push-up machine taken in the direction of line 10-10 in FIG. 1 and moving between a deployed position and a storage position;

FIG. 11 is a detail view of an attachment and interconnection of the elevated platform to the base shown in FIG. 10; and FIG. 12 is a partial exploded view of the attachment taken in the direction of line 12-12 in FIG. 11.

V. DETAILED DESCRIPTION

The word "exemplary" is used herein to mean "serving as an example, instance, or illustration." Any embodiment or design described herein as "exemplary" is not necessarily to be construed as preferred or advantageous over other embodiments or designs.

Figure 1:
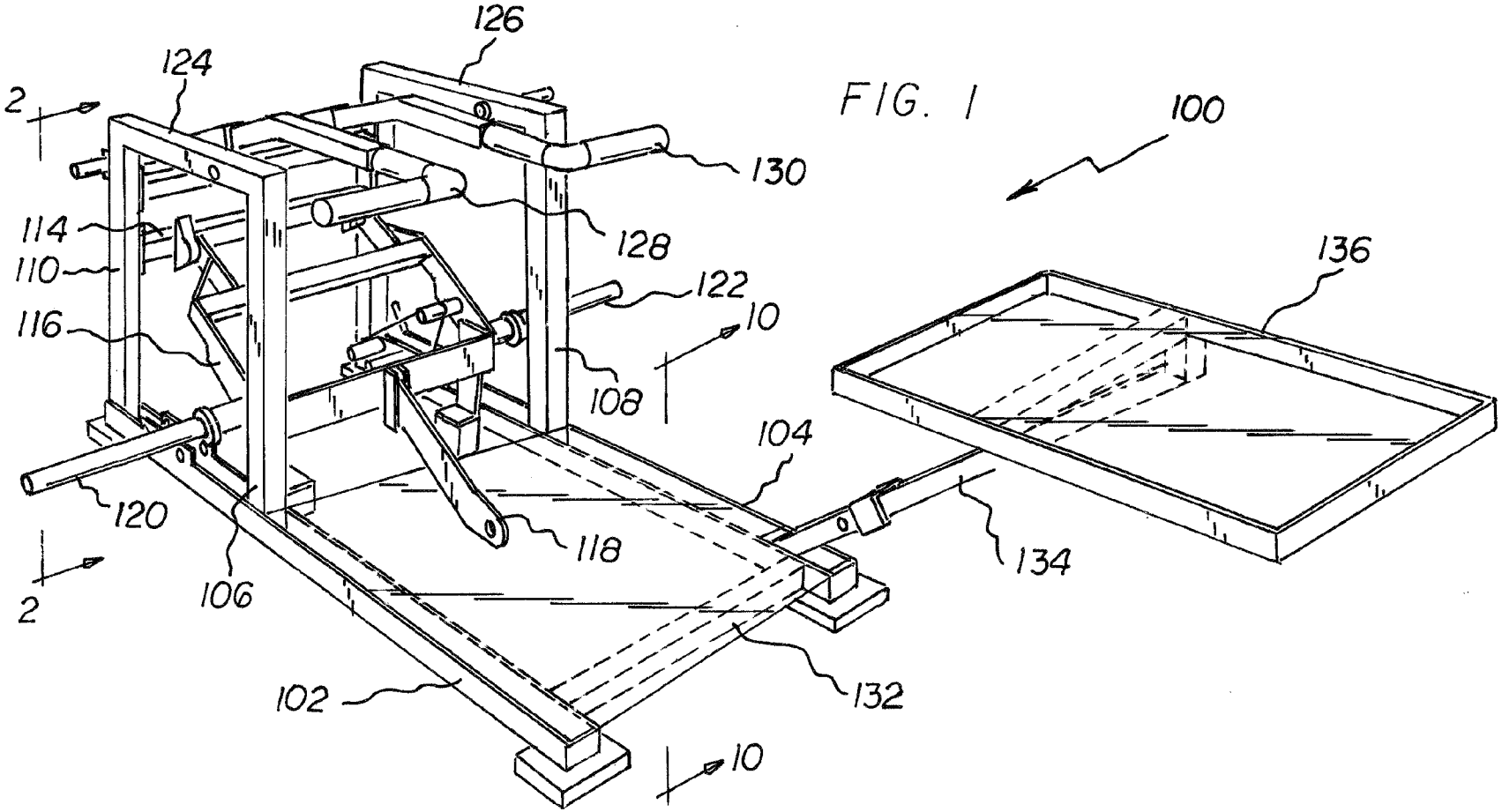
FIG. 1 is a perspective view of a particular illustrative embodiment of a weighted push-up exercise machine.

Referring now to FIG. 1, an exemplary embodiment of a weighted push-up machine is disclosed and generally designated 100. A left front vertical frame member 106 extends upwardly from a left base member 102. Similarly, a right front vertical frame member 108 is fixed to a right base member 104 and extends upwardly. The front vertical frame members 106, 108 are substantially parallel to one another in the preferred embodiment.

At the rear of the machine 100, a left rear vertical frame member 110 is secured to the left base member 102 and a right rear vertical frame member 112 is fixed to the right base member 104. A rear horizontal member 114 spans between the left rear vertical member 110 and the right rear vertical member 112. A proximate end of a lever arm 116 is coupled pivotally to the horizontal member 114. The lever arm 116 is configured to provide resistance against a vertical movement of a distal end of the lever arm 116. A flange 118 extends outwardly from the distal end of the lever arm 116. The flange 118 is configured to receive a connector suspended from a belt or harness worn by a user. For example, the connector may be a carabiner that is adapted to clip to the flange 118, where the carabiner is suspended from the belt or harness using a chain or cord. A pair of hand grips 128, 130 are disposed above the flange 118 so that when a user is in the push-up position on the machine, the connector hangs down to the flange 118 to be secured thereto and connect the user to the lever arm 116 via the flange 118. The length of the chain or cord is adjustable to accommodate the distance between a particular user and the flange 118 when performing the push-up exercises.

The resistance can be provided by, among other things, free weights 154 that can be loaded on to a left peg 120 and a right peg 122. The free weights 154 are known in the art to be generally disc shaped with a center aperture. The pegs 120, 122 may have a telescoping feature that allows the pegs 120, 122 to be retracted or extended as necessary to accommodate the desired number of free weights 154. The left rear vertical member 110 and the left front vertical member 106 are connected by left cross member 124 that provides stability to the machine 100. Similarly, on an opposing side of the machine 100, a right cross member 126 connects a right rear vertical member 112 and the right front vertical member 108. In addition, a front lower cross member 132 connect a front portion of the left base member 102 and right base member 104.

In addition, an elevated platform 136 is secured to the machine 100 using a strut 134. The elevated platform 136 is spaced apart from the pair of hand grips 128, 130 a desired distance that is based on a height (or length) of the user when performing push-up exercises. For example, the machine 100 is configured to use in a horizontal position by the user grasping the hand grips 128, 130 and resting the feet of the user on the elevated platform 136 and performing push-up exercises against the resistance provided by the lever arm 116. The push-up exercise is generally performed using a motion of bending at the elbows of the user to bring the chest downward, and reversing direction and extending the arms to raise the chest, and repeating the motion. The lever arm 116 is configured to be raised by the user such that resistance is felt by the user as the user raises the lever arm 116 in an up and down motion when doing the push-up exercises. The resistance may be provided by any means such as, for example, the free weights 154 loaded using the weight pegs 120, 122, through resistance bands 152 secured to the lever arm 116 and an anchor point on the exercise machine 100, or using pneumatic resistance, a weight stack, or any other type or combination of resistance.

The elevation of the feet of the user to the desired height may be accomplished using alternative means in addition to the elevated platform 136 described herein. For example, a ladder, steps, boxes, other exercise equipment, pads or mats, or any combination thereof, may be used to provide the correct height for resting the feet of the user when performing the weighted push-up exercises instead of the elevated platform 136.

Figure 2:
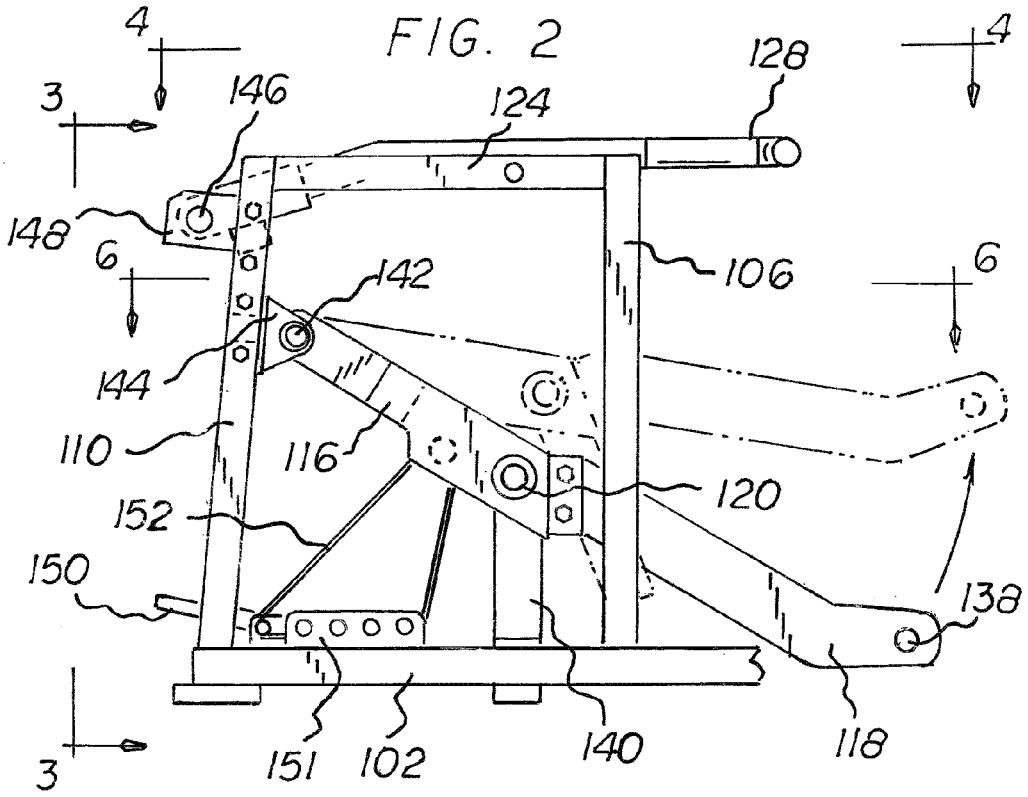
FIG. 2 is an elevational view of the weighted push-up machine taken in the direction of line 2-2 in FIG. 1 and illustrating a lever arm moving in the vertical direction against resistance provided by a tension band.

Referring now to FIG. 2, the lever arm 116 is shown moving between a lower position and an upper position. The proximate end of the lever arm 116 is secured to the horizontal member 114 using a left bracket 144 and a right bracket 145 with a shaft 142 that allows the proximate end of the lever arm 116 to pivot or rotate on the shaft 142 as the flange 118 at the distal end of the lever arm 116 is moved in an up and down motion. A left bumper 140 is secured to the lever arm 116 that supports the lever arm 116 at a desired height when the machine 100 is not in use. In addition, the left bumper 140 prevents the lever arm 116 and flange 118 from hitting the floor when the user is moving the lever arm 116 between the upper and lower position. The right side of the machine 100 has a similar configuration of a right bumper 158 to support the lever arm 116. Disposed in the flange 118 is a connector aperture 138 for securing the connector such as a carabiner or ring that is connected to a belt or harness worn by the user that transfers the resistance when performing the push-up exercises.

Figure 3:
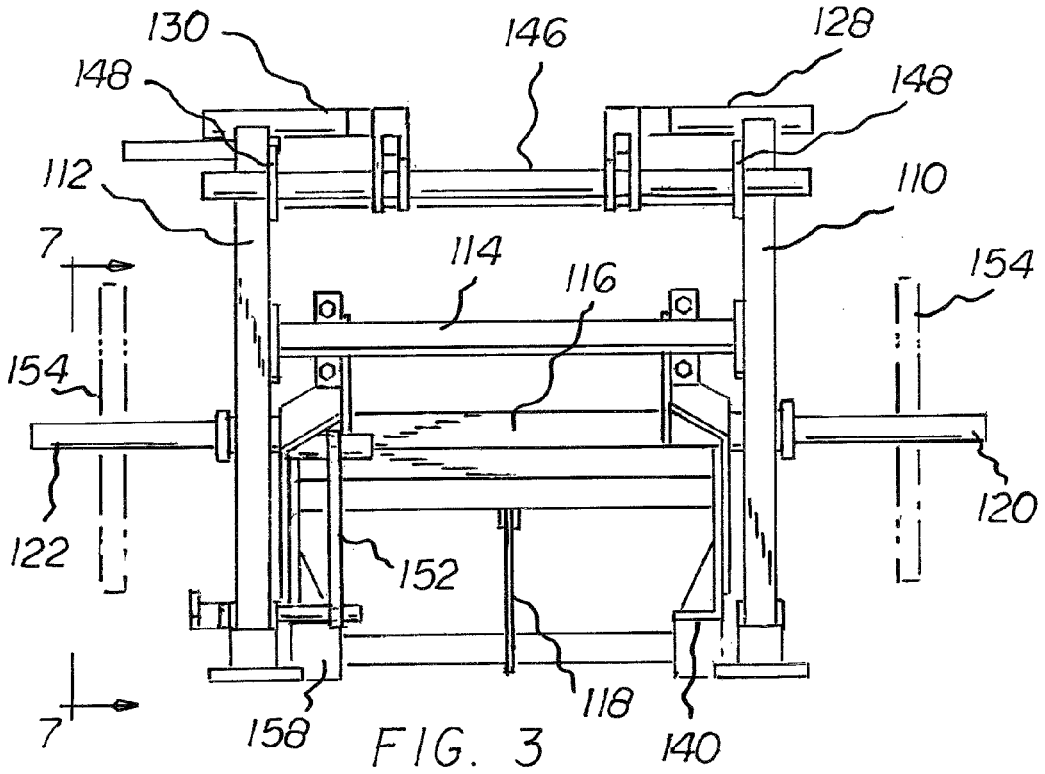
FIG. 3 is a rear view of the weighted push-up machine taken in the direction of line 3-3 in FIG. 2.
Figure 4:
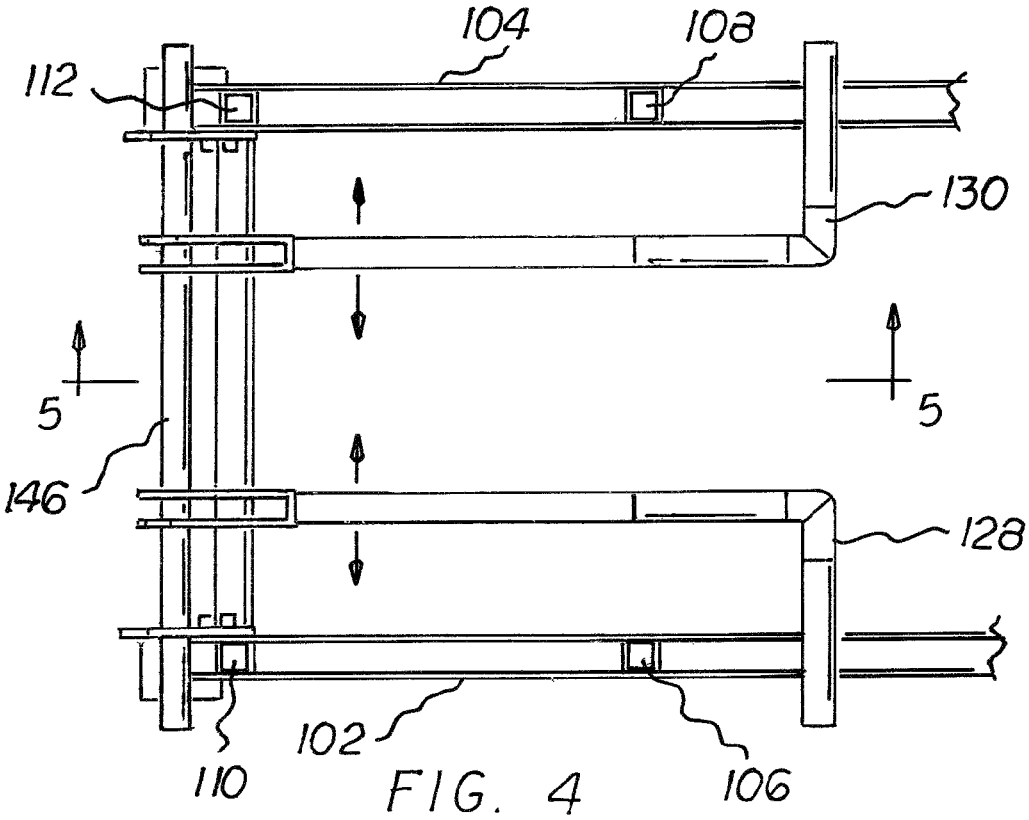
FIG. 4 is a partial top view of the weighted push-up machine taken in the direction of line 4-4 in FIG. 2.
Figure 5:
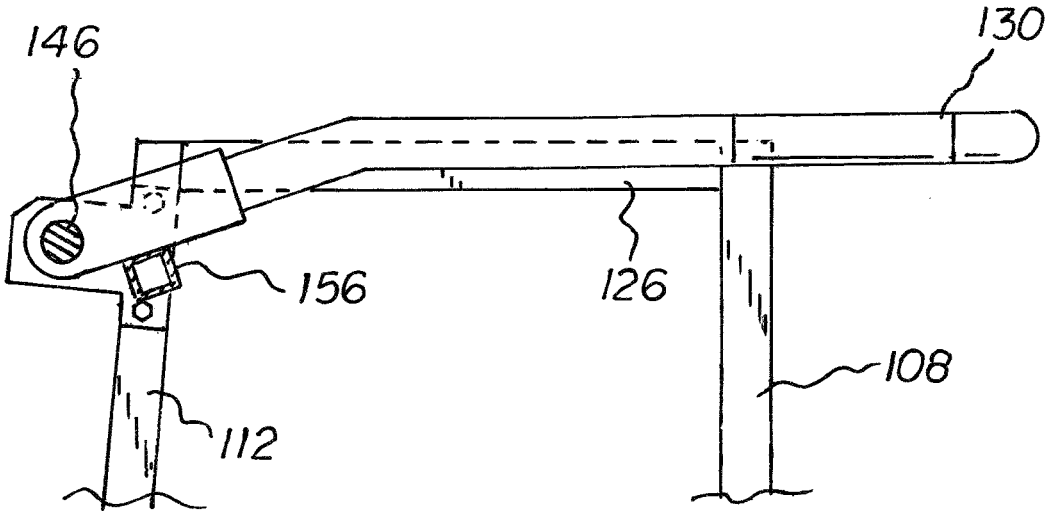
FIG. 5 is a partial elevational view of a hand grip of the weighted push-up machine taken in the direction of 5-5 in FIG. 4.

As best illustrated in FIGS. 3-5, the hand grips 128, 130 are configured to move relative to each other to adjust a width between them. Accordingly, the hand grips 128, 130 are adapted to accommodate different sizes of users and also to adapt the machine 100 to work specific muscle groups when performing the push-up exercises. The adjustment of the hand grips 128, 130 may be accomplished by mounting a proximate end of each hand grip 128, 130 to a horizontal shaft 146. A pair of brackets 148 are used to secure the horizontal shaft 146 to span between the rear left vertical member 110 and the rear right vertical member 112. The hand grips 128, 130 are cantilevered out from the horizontal shaft 146 and the proximate ends of the hand grips 128, 130 are configured to slide independently along the horizontal shaft 146 in either direction.

For example, the left hand grip 128 can be moved towards the outside of the machine 100 by lifting the distal end of the hand grip 128 upwards so that the distal end rotates about the horizontal shaft 146 and sliding the hand grip 128 outward. The right hand grip 130 can be moved similarly. After the hand grips 128, 130 have been moved to the desired location, the hand grips 128, 130 are lowered down to engage a stop 156 that maintains the hand grips 128, 130 in a substantially horizontal position. In an alternative embodiment, the distal ends of the hand grips 128, 130 may be secured to the horizontal shaft 146, which is threaded, such that the proximate ends of the hand grips 128, 130 are adapted to screw on to the horizontal shaft 146 to allow the hand grips 128, 130 to move along the horizontal shaft 146 by rotating the shaft 146 or other mechanism.

Figure 6:
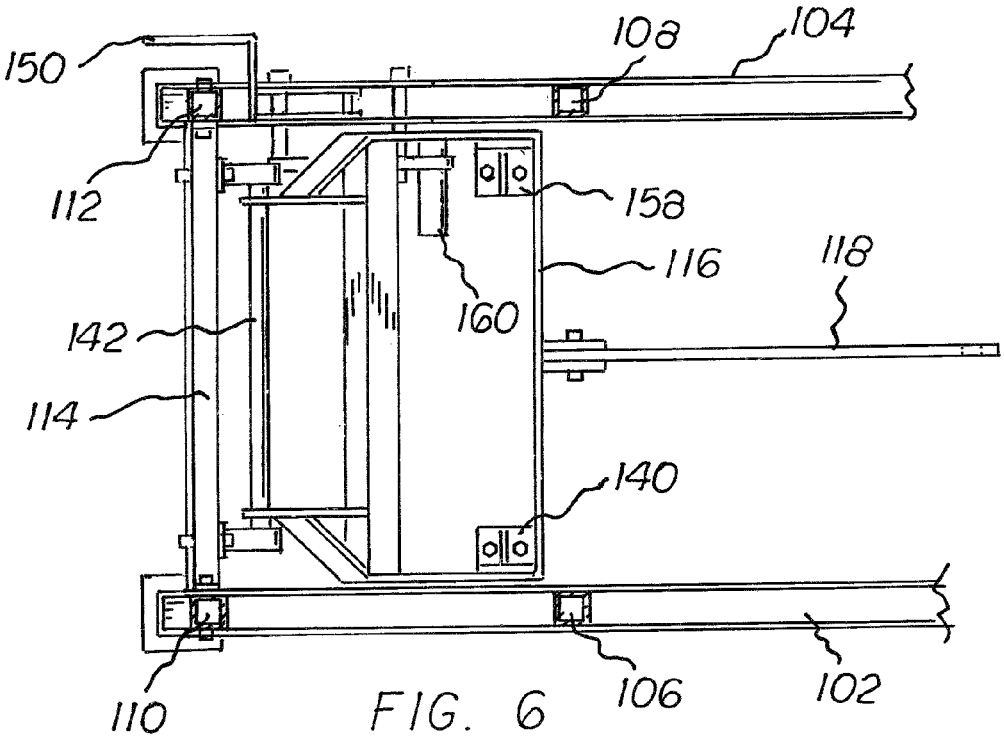
FIG. 6 is a partial top view of the lever arm of the weighted push-up machine taken in the direction of 6-6 in FIG. 2.

Referring now to FIG. 6, the lever arm 116 is shown coupled pivotally to the shaft 142, which is fixed to the horizontal member 114. As described above, the distal end of the lever arm 116 includes a left bumper 140 and a right bumper 158 disposed on opposing sides of the lever arm 116. The flange 118 is centrally disposed on the lever arm 116 and extends outwardly away from the lever arm 116. The flange 118 may be bolted or welded to the lever arm 116.

A peg 160 is fixed to the lever arm 116 and configured to be used with a resistance band 152 described below. Another peg may be used on an opposing side of the lever arm 116 for additional resistance bands. The horizontal bar 114 is shown fixed at the rear portion of the machine 100 and spans between the left rear vertical member 110 and the right rear vertical member 112.

Figure 7:
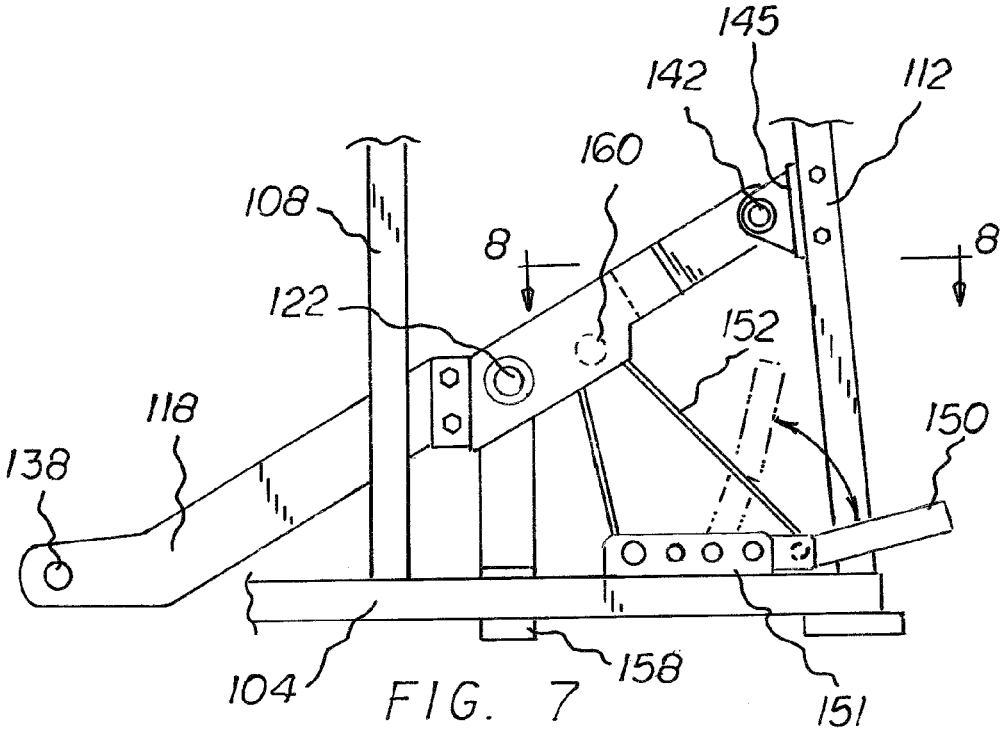
FIG. 7 is a partial elevational view of the weighted push-up machine taken in the direction of 7-7 in FIG. 3 loaded with a tension band.

As shown in FIG. 7, the lever arm 116 slopes generally from the shaft 142 where the lever arm 116 is pivotally coupled down to the flange 118 where the user connects to the belt or harness. The machine 100 is loaded with a resistance band 152 and ready for the user to connect using aperture 138 disposed in the flange 118. The handle 150 is shown moving between two positions, where the handle 150 in a down position places the resistance band 152 under tension. The resistance band 152 is looped around peg 160 down to the right base member 104 so that when the handle 150 is moved downward as shown in FIG. 7, the resistance band 152 is stretched. Accordingly, when the user is connected to the flange 118 and in position to perform the weighted push-up exercises, the user is in effect pushing against the resistance band 152 when raising the flange 118 and the lever arm 116.

Figure 8:
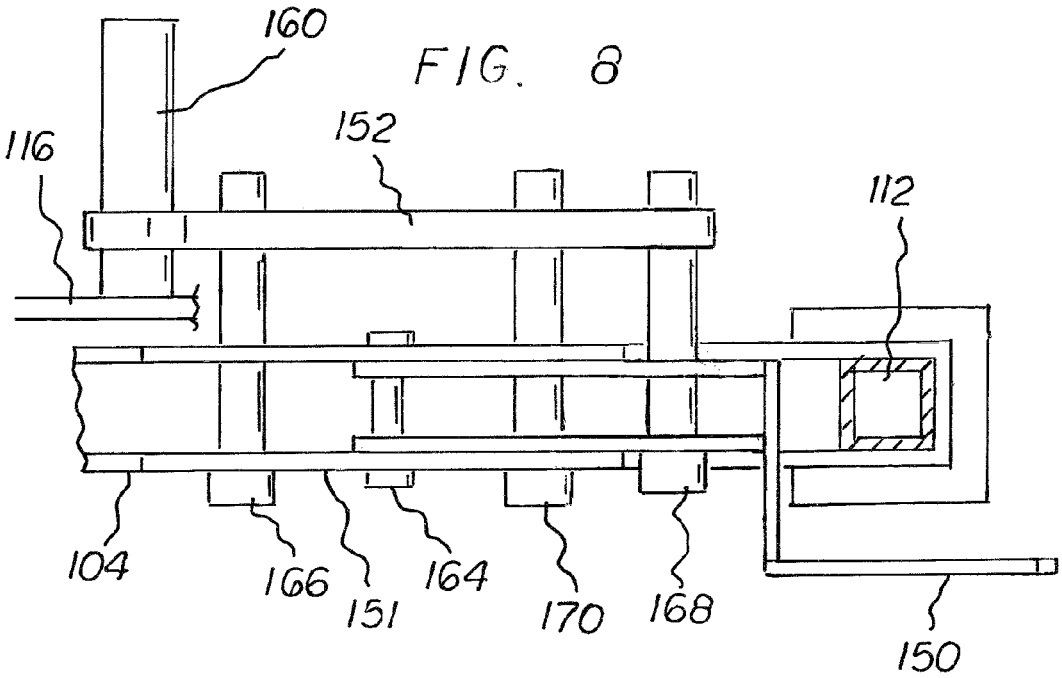
FIG. 8 is a partial top view of the weighted push-up machine taken in the direction of 8-8 in FIG. 7 loaded with a tension band to increase the resistance of the lever arm.

Referring now to FIG. 8, the user places tension in the resistance band 152 by rotating the handle 150 between the up position and the down and locked position about pivot pin 164. In use, a first end of the resistance band 152 is placed over peg 160 that is fixed to the lever arm 116 and a second end of the resistance band 152 is looped over pin 168. The resistance band 152 is also sequentially looped around pin 166 that is secured through channel 151. The user rotates the handle 150 downward causing the resistance band 152 to stretch and be placed in tension. Once the handle 150 is pushed all the way down, then locking pin 170 is inserted through the channel 151 to keep the handle 150 in the down position and the resistance band 152 under tension. Accordingly, when the user raises the lever arm 116, peg 160 that is fixed to the lever arm 116 is also raised causing the resistance band 152 to stretch and resist the movement by the user performing the push-up exercises. The left side of the machine 100 may also be configured to receive resistance bands similar to the right side of the machine 100.

The channel 151 is installed on the top of the right base member 104 and may be welded or bolted thereto. Although the resistance band 152 is shown as a loop, the resistance band 152 can also be a single length secured between the peg 160 and the right base support 104. In operation, the user would grasp the hand grips 128, 130 and place the feet of the user on the elevated platform so that the user is in a substantially horizontal position and connected to the lever arm 116. The arms of the user would then be used to move against the tension of the resistance band 152 (and weight of the lever arm 116) by moving the lever arm 116 upwards as the user's body moves upwards when doing the weighted push-up exercises. Any number of resistance bands 152 may be used, where more bands 152 increases the resistance and more strength is required to install the bands 152 and place under tension. Thus, using the handle 150 to add and remove the resistance bands 152 is easy by using a mechanical advantage.

The handle 150 is shown in the down and locked position in the drawings. The locking pin 170 has been inserted. Thus, the handle 150 will remain in the locked position allowing the resistance band 152 to be used under significant tension. The tension band 152 has been stretched to increase the resistance to the user during exercising. The pivot pin 164 acts as a fulcrum so that the force needed to overcome the load imparted by the resistance band 152 is reduced. It is relatively impossible, if not impossible, to stretch the resistance band 152 by hand to the tension levels that the handle 150 can achieve due to its mechanical advantage. A similar handle 150 and tension band 152 may be used on the opposing side of the machine 100.

Figure 9:
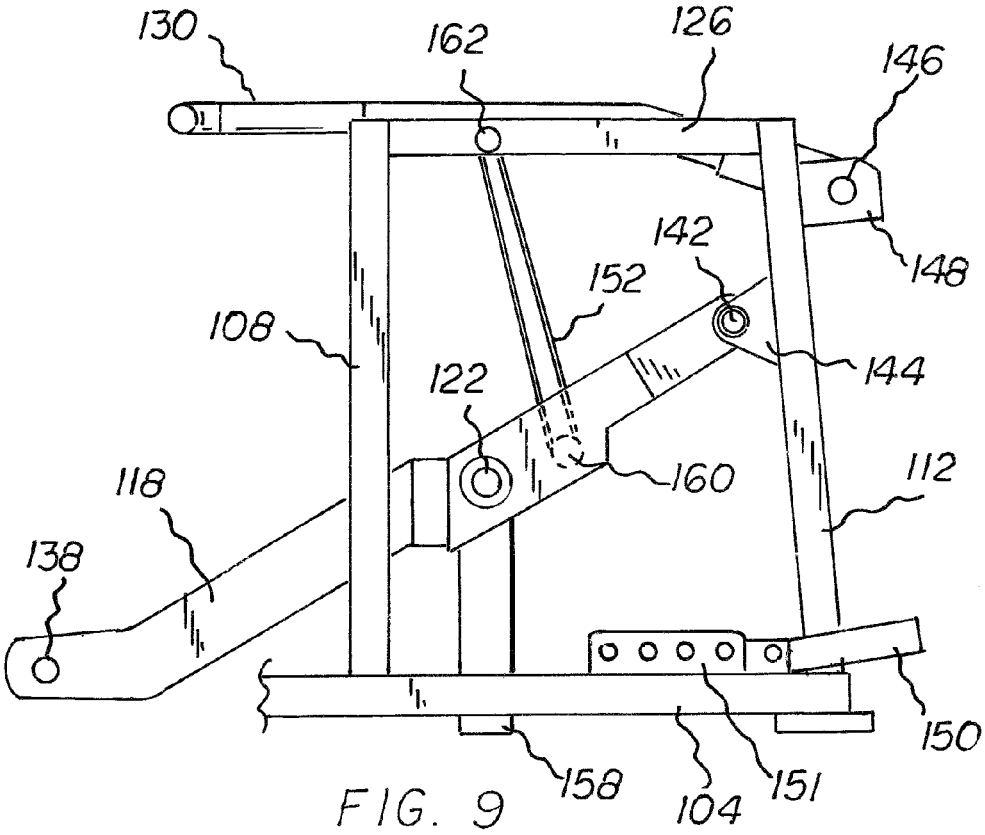
FIG. 9 is an elevational view of the weighted push-up machine with a tension band loaded on the lever arm to reduce the resistance of the lever arm.

Referring now to FIG. 9, the resistance band 152 can also be used to reduce the effort needed to raise the flange 118 and lever arm 116. For example, the resistance band 152 can be looped around an upper pin 162 fixed to the right cross member 126 and the other end of the resistance band 152 around peg 160, which is secured to the lever arm 116. Accordingly, the resistance band 152 in this particular configuration assists the user in raising the weight of the flange 118 and lever arm 116 when performing the push-up exercises. This is ideal for beginners or users that may be rehabilitating an injury or for physical therapy.

As illustrated in FIG. 10, the elevated platform 136 may be pivotally secured to the right base member 104 so that the elevated platform can be rotated between a deployed position and a stored position. The elevated platform 136 could also be mounted to the left base member 102 or to another alternative location of the machine 100 as desired. When the machine 100 is being used, the elevated platform 136 can be rotated out so that a top portion of the elevated platform 136 is substantially horizontal so that the feet of the user are supported to maintain a torso of the user also in a horizontal position. The elevated platform 136 can be rotated inward about the right base member 104 to reduce the footprint of the machine 100, which is a significant advantage in weight rooms where space is at a premium. The elevated platform 136 is supported by the strut 134 that connects the elevated platform 136 to the right base member 104.

A detail view of one particular embodiment of the connection of the strut 134 to the right base member 104 is shown in FIGS. 11-12. A rotator pin 174 is disposed on a lower end of the strut 134 that rotatably connects the strut 134 to a stub 176. The stub 176 is fixed and angled upward away from the right base member 104. The stub 176 may be angle iron where the strut 134, which may be a box channel, is adapted to fit into the side of the stub 176 so that the strut 134 can rotate into the stub 176 and the stub 176 supports the strut 134 at the desired angle. A stiffener 178 may be used to secure the rotator pin 174 at the end of the strut 134.

The previous description of the disclosed embodiments is provided to enable any person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A weighted push-up exercise machine, the machine comprising:
- a base structure;
- a lever arm having a proximate end coupled pivotally to the base structure and the lever arm configured to provide a resistance against vertical movement of a distal end of the lever arm positioned below a user;
- a flange extending outwardly from the distal end of the lever arm;
- an aperture disposed in the flange;
- a pair of hand grips secured to the base structure in a horizontal position above the flange and the pair of hand grips configured to be grasped by the user; and
- an elevated platform spaced apart from the pair of hand grips and spaced horizontally apart from the lever arm and configured to support feet of the user;
- wherein the machine is configured for the user to use by grasping the pair of hand grips and resting the feet of the user on the elevated platform and performing push-up exercises against the resistance of the vertical movement of the distal end of the lever arm while the pair of hand grips remain stationary; and wherein the pair of hand grips are configured to move relative to one another to adjust a width therebetween when the pair of hand grips are in the horizontal position and aligned collinearly.

2. The weighted push-up exercise machine of claim 1, wherein the elevated platform is pivotally secured to the base structure and configured to rotate between a storage position and a deployed position.

3. The weighted push-up exercise machine of claim 1, further comprising a series of apertures along the base structure and configured to receive a support strut of the elevated platform to adjust a distance between the pair of hand grips and the elevated platform.

4. The weighted push-up exercise machine of claim 1, further comprising a straight shaft secured to the base structure for engaging the pair of hand grips, wherein the pair of hand grips are cantilevered out from the straight shaft and the pair of hand grips are configured to be adjustably positioned along the straight shaft.

5. The weighted push-up exercise machine of claim 1, wherein the lever arm further comprises a weight peg disposed on the lever arm and the weight peg is configured to receive free weights thereon and to provide the resistance.

6. The weighted push-up exercise machine of claim 5, wherein the weight peg is configured to accommodate a desired amount of the free weights.

7. The weighted push-up exercise machine of claim 1, the lever arm further comprising an upper tension pin configured to receive a first end of a tension band thereon, and the base structure having a lower tension pin configured to receive a second end of the tension band, wherein the tension band is elastic and configured to provide the resistance as the user is moving the lever arm when performing the push-up exercises.

8. A weighted push-up exercise machine, the machine comprising:
- a base;
- a lever arm having a proximate end coupled pivotally to the base and the lever arm having a distal end configured to provide a resistance against vertical movement of the distal end of the lever arm positioned below a user;
- the distal end of the lever arm having an aperture; and
- a pair of hand grips secured to the base in a horizontal position above the lever arm;
- wherein the machine is configured for the user to use by grasping the pair of hand grips and performing push-up exercises against the resistance of the vertical movement of the distal end of the lever arm located below the user while the pair of hand grips remain stationary; and wherein the pair of hand grips are configured to move relative to one another to adjust a width therebetween when the pair of hand grips are in the horizontal position and aligned collinearly.

9. The weighted push-up exercise machine of claim 8, further comprising an elevated platform that is adjustably positioned in height relative to the pair of hand grips.

10. The weighted push-up exercise machine of claim 9, further comprising a support strut of the elevated platform that is movable to adjust a distance between the pair of hand grips and the elevated platform.

11. The weighted push-up exercise machine of claim 8, wherein the pair of hand grips are cantilevered outwards from the machine.

12. The weighted push-up exercise machine of claim 8, wherein the lever arm further comprises a weight peg extending outside a perimeter of the base and configured to receive a free weight thereon to provide the resistance.

13. The weighted push-up exercise machine of claim 12, the machine further comprising:
- an upper tension pin secured to the lever arm configured to receive a first end of a tension band thereon; and
- a stationary lower tension pin secured to the machine and configured to receive a second end of the tension band;
- wherein the tension band is elastic and configured to resist the user as the user is moving the lever arm when performing push-up exercises.

14. The weighted push-up exercise machine of claim 8, wherein the resistance against vertical movement of the distal end of the lever arm being configured to use free weights, tension bands, or any combination thereof.

15. A weighted push-up exercise machine, the machine comprising:
- a base;
- a lever arm having a proximate end coupled pivotally to the base and the lever arm having a distal end configured to provide a resistance against vertical movement of the distal end of the lever arm positioned below a user; and
- a pair of hand grips disposed above the lever arm and the pair of hand grips configured to be grasped by the user;
- wherein the machine is configured for the user to use in a horizontal position by grasping the pair of hand grips and resting feet of the user on an elevated platform and performing push-up exercises against the resistance of the vertical movement of the distal end of the lever arm while the pair of hand grips remain stationary; and wherein the pair of hand grips are configured to move relative to one another to adjust a width therebetween when the pair of hand grips are aligned collinearly in a horizontal plane.

16. The weighted push-up exercise machine of claim 15, wherein the elevated platform is spaced apart from the pair of hand grips and spaced horizontally apart from the lever arm, and configured to support the feet of the user.

* * * * *